US009592942B2

(12) United States Patent
Walling

(10) Patent No.: US 9,592,942 B2
(45) Date of Patent: Mar. 14, 2017

(54) CARTON AND CARTON BLANK

(71) Applicant: Westrock Packaging Systems, LLC, Norcross, GA (US)

(72) Inventor: Bradford J. Walling, Chesterfield, VA (US)

(73) Assignee: WestRock Packaging Systems, LLC, Norcross, GA (US)

( * ) Notice: Subject to any disclaimer, the term of this patent is extended or adjusted under 35 U.S.C. 154(b) by 0 days.

(21) Appl. No.: 15/021,748

(22) PCT Filed: Sep. 11, 2014

(86) PCT No.: PCT/US2014/055152

§ 371 (c)(1),
(2) Date: Mar. 14, 2016

(87) PCT Pub. No.: WO2015/038748

PCT Pub. Date: Mar. 19, 2015

(65) Prior Publication Data

US 2016/0229611 A1 Aug. 11, 2016

Related U.S. Application Data

(60) Provisional application No. 61/877,330, filed on Sep. 13, 2013.

(51) Int. Cl.
*B65D 71/36* (2006.01)
*B65D 5/468* (2006.01)

(52) U.S. Cl.
CPC ..... *B65D 71/36* (2013.01); *B65D 2571/0066* (2013.01); *B65D 2571/00141* (2013.01); *B65D 2571/00469* (2013.01); *B65D 2571/00524* (2013.01); *B65D 2571/00543* (2013.01); *B65D 2571/00549* (2013.01); *B65D 2571/00728* (2013.01)

(58) Field of Classification Search
None
See application file for complete search history.

(56) References Cited

U.S. PATENT DOCUMENTS 3,904,036 A 9/1975 Forrer
3,933,303 A 1/1976 Kirby, Jr.
5,307,932 A 5/1994 Stout
(Continued)

FOREIGN PATENT DOCUMENTS

EP 0713470 B 1/2000

*Primary Examiner* — Gary Elkins
(74) *Attorney, Agent, or Firm* — WestRock Intellectual Property Group

(57) ABSTRACT

A carton has panels including a top panel (12/20), a base panel (16), a first side panel (14) and a second side panel (18) forming a tubular structure. One of the panels includes a handle structure (h) defined in it. The handle structure includes a first pair of folding structures (R, R) each having at least one first fold line (X, Y, Z) defining a first edge of a handle strap and a second pair of folding structures each having at least one second fold line defining a second edge of the handle strap. Each of the at least one first fold lines and the at least one second fold lines is defined, at least in part, in the one of the panels, wherein the carton includes a mandrel panel (22) disposed in face contacting relationship with the inner surface of the one (20) of the panels.

20 Claims, 5 Drawing Sheets

(56) References Cited

U.S. PATENT DOCUMENTS

| | | | | | |
|---|---|---|---|---|---|
| 5,333,734 | A | | 8/1994 | Stout | |
| 5,996,883 | A | * | 12/1999 | Bates | B65D 5/46072 229/117.12 |
| 6,302,320 | B1 | * | 10/2001 | Stout | B65D 5/46192 229/117.13 |
| 8,070,052 | B2 | * | 12/2011 | Spivey, Sr. | B65D 71/36 229/117.13 |
| 8,840,009 | B2 | * | 9/2014 | Spivey, Sr. | B65D 71/36 229/117.13 |
| 9,010,620 | B2 | * | 4/2015 | Sutherland | B65D 5/4608 229/117.13 |
| 9,126,716 | B2 | * | 9/2015 | Kohler | B65D 5/46072 |
| 2008/0048014 | A1 | * | 2/2008 | Bates | B65D 71/36 229/117.13 |
| 2012/0091021 | A1 | * | 4/2012 | Smalley | B65D 71/36 206/427 |

* cited by examiner

CARTON AND CARTON BLANK

CROSS REFERENCE TO RELATED APPLICATIONS

This application is a National Phase application of PCT Application PCT/US2014/55152 filed Sep. 11, 2014, which claims the benefit of U.S. Provisional Patent Application No. 61/877,330 filed Sep. 13, 2013, each of which is incorporated herein by reference in its entirety.

TECHNICAL FIELD

The present invention relates to a carton and to a blank for forming the carton more specifically, but not exclusively, to a carton having a carrying handle for carrying the carton.

BACKGROUND

In the field of packaging it is often required to provide consumers with a package comprising multiple primary product containers. Such multi-packs are desirable for shipping and distribution and for display of promotional information. For cost and environmental considerations, such cartons or carriers need to be formed from as little material as possible and cause as little wastage in the materials from which they are formed as possible. Another consideration is the strength of the packaging and its suitability for holding and transporting large weights of articles.

It is desirable to provide a carton with a carrying handle for transportation by a consumer.

The present invention seeks to overcome or at least mitigate the problems of the prior art.

SUMMARY

According to a first aspect of the present invention there is provided a carton for packaging one or more articles, the carton comprising a plurality of panels including a top panel, a base panel, a first side panel and a second side panel forming a tubular structure, one of the plurality of panels including a handle structure defined therein, the handle structure including a first pair of folding structures each having at least one first fold line defining a first edge of a handle strap and a second pair of folding structures each having at least one second fold line defining a second edge of a handle strap, the second edge opposing the first edge, each of the at least one first fold lines and the at least one second fold lines being defined, at least in part, in said one of the plurality of panels, wherein the carton comprises a mandrel panel disposed in face contacting relationship with an inner surface of said one of the plurality of panels, the mandrel panel comprising a first edge and a second edge, the second edge opposing the first edge, the first edge configured to facilitate folding of the first pairs of folding structures, the second edge configured to facilitate folding of the second pair of folding structures.

Optionally, each of the first edge and the second edge of the mandrel panel are, at least in part, free edges.

Preferably, each of the first edge and the second edge of the mandrel panel are, at least in part, free edges.

In some embodiments, each of the free edges of the mandrel panel is shaped complementary to the handle strap to provide a guide about which the first and second edges of the handle strap fold when the carrying handle is employed.

Optionally, said one of the plurality of panels is formed from a first panel and a second panel disposed in at least partially overlapping relationship.

Optionally, the first pair of folding structures is defined in the first panel and the second pair of folding structures is defined in the second panel.

The mandrel panel may be hinged to the one of the first and second panels.

Preferably, the mandrel panel is hinged to the innermost one of the first and second panels.

Optionally, the handle structure comprises a first aperture and a second aperture, the second aperture being spaced apart from the first aperture and defining a handle strap therebetween.

Preferably, the first aperture is struck from the first panel and the second aperture is struck from the second panel.

Optionally, the first aperture is defined in part by a first cushioning flap hinged to the first panel by a first hinged connection.

In some embodiments, the first hinged connection defines in part the first side edge of the handle strap.

Optionally, the second aperture is defined in part by a second cushioning flap hinged to the second panel by a second hinged connection.

In some embodiments, the second hinged connection defines in part the second side edge of the handle strap.

Each of the first pair of folding structures may comprise three fold lines.

Optionally, the three fold lines intersect one another at a common vertex proximate the first aperture.

Optionally, each of the three fold lines intersects a weakened line of severance extending between a side edge of the top panel and an end edge of the top panel.

Optionally, one of the three fold lines extends into a side panel.

Each of the second pair of folding structures may comprise three fold lines.

Optionally, the three fold lines intersect one another at a common vertex proximate the second aperture.

Optionally, each of the three fold lines intersects a weakened line of severance extending between a side edge of the top panel and an end edge of the top panel.

Optionally, one of the three fold lines extends into a side panel.

According to a second aspect of the present invention there is provided a blank for forming a carton, the blank comprising a plurality of panels for forming a top panel, a base panel, a first side panel and a second side panel forming a plurality of walls of a tubular structure in a set-up carton, one of the plurality of walls including a handle structure defined in at least one of the plurality of panels, the handle structure including a first pair of folding structures each having at least one first fold line defining a first edge of a handle strap and a second pair of folding structures each having at least one second fold line defining a second edge of a handle strap, the second edge opposing the first edge, each of the at least one first fold lines and the at least one second fold lines being defined, at least in part, in said one of the plurality of panels, wherein the blank comprises a mandrel panel, the mandrel panel comprising a first edge and a second edge, the second edge opposing the first edge, the first edge configured to facilitate folding of the first pairs of folding structures, the second edge configured to facilitate folding of the second pair of folding structures.

Optionally, said one of the plurality of walls is a composite panel formed from a first panel of said plurality of panels and a second panel of plurality of panels, the first and second panels being configured to be disposed in at least partially overlapping relationship in a set-up carton.

Optionally, the first pair of folding structures is defined in the first panel and the second pair of folding structures is defined in the second panel.

The mandrel panel may be hinged to the first panel by a fold line.

Optionally, the blank comprises an aperture struck in part from the mandrel panel and in part from said one of the first and second panels.

Optionally, the blank comprises a recess struck from the mandrel panel.

In some embodiments, the recess defines at least a portion of a first free edge of the mandrel panel.

In some embodiments, a portion of the aperture defines a second free edge of the mandrel panel.

Optionally, the first free edge of the mandrel panel is configured to align with the first pair of folding structures.

Optionally, the second free edge of the mandrel panel is configured to align with the second pair of folding structures.

According to a third aspect of the present invention there is provided a carton for packaging one or more articles, the carton comprising a plurality of panels including a top panel, a base panel, a first side panel and a second side panel forming a tubular structure, the top panels including a handle structure defined therein the handle structure including a first aperture and a second aperture, the second aperture being spaced apart from the first aperture and defined a handle strap therebetween, the handle structure comprising a first folding structure extending from a first end of the first aperture to a first corner of the top panel, a second folding structure extending from a first end of the second aperture to a second corner of the top panel, a third folding structure extending from a second end of the first aperture to a third corner of the top panel, a fourth folding structure extending from a second end of the second aperture to a fourth corner of the top panel, each folding structure comprising a weakened line of severance extending between a side edge of the top panel and an end edge of the top panel, each folding structure comprising a first fold line extending from the respective one of the first and second ends of the first and second apertures to the respective weakened line of severance, wherein each folding structure defines a target region of the top panel, the target region being defined by a first notional line, a second notional line and the weakened line of severance, the first notional line extending between the point at which the fold line intersects the respective one of the first and second ends of the first and second apertures and the point at which the weakened line of severance intersects the side edge of the top panel, the second notional line extending between the point at which the fold line intersects the respective one of the first and second ends of the first and second apertures and the point at which the weakened line of severance intersects the end edge of the top panel, and wherein the carton comprises a mandrel panel disposed in face contacting relationship with an inner surface of the top panel, the mandrel panel comprising a first edge and a second edge, the second edge opposing the first edge, the first edge configured to facilitate folding of the first folding structure and second folding structure, the second edge configured to facilitate folding of the third folding structure and the fourth folding structure, at least part of the first edge of the mandrel panel being disposed in vertical alignment with the target region of the first folding structure and the target region of second folding structure, at least part of the second edge of the mandrel panel being disposed in vertical alignment with the target region of the third folding structure and the target region of fourth folding structure.

According to a fourth aspect of the present invention there is provided a carton for packaging one or more articles, the carton comprising a plurality of panels including a top panel, a base panel, a first side panel and a second side panel forming a tubular structure, the composite top panel provides a handle structure the handle structure including a first aperture and a second aperture, the second aperture being spaced apart from the first aperture and defined a handle strap therebetween, the handle structure comprising a first folding structure extending from a first end of the first aperture to a first corner of the top panel, the first folding structure comprising a weakened line of severance extending between a first side edge of the top panel and a first end edge of the top panel, the first folding structure comprising a first fold line extending from a first end of the first aperture to the weakened line of severance, wherein the first folding structure defines a first target region of the top panel, the first target region being defined by a first notional line, a second notional line and the weakened line of severance, the first notional line extending between the point at which the first fold line intersects the first end of the first aperture and the point at which the weakened line of severance intersects the first side edge of the top panel, the second notional line extending between the point at which the first fold line intersects the first end of the first aperture and the point at which the weakened line of severance intersects the first end edge of the top panel, and wherein the carton comprises a mandrel panel disposed in face contacting relationship with an inner surface of the top panel, the mandrel panel comprising a first free edge, the first free edge configured to facilitate folding of the first folding structure, an end of the first free edge of the mandrel panel being disposed in vertical alignment with the first target region of the first folding structure.

Optionally, the mandrel panel comprises a second free edge, the second free edge opposing the first free edge, the first and second free edge being convergent towards the first and second apertures, the second free edge configured to facilitate folding of a second folding structure provided by the composite top panel, the second folding structure comprising a second weakened line of severance extending between a second side edge of the top panel and the first end edge of the top panel, the second folding structure comprising a second fold line extending from a first end of the second aperture to the weakened line of severance, wherein the second folding structure defines a second target region of the top panel, the second target region being defined by a third notional line, a fourth notional line and the second weakened line of severance, the third notional line extending between the point at which the third fold line intersects the first end of the second aperture and the point at which the second weakened line of severance intersects the second side edge of the top panel, the fourth notional line extending between the point at which the second fold line intersects the first end of the second aperture and the point at which the second weakened line of severance intersects the first end edge of the top panel, an end of the second free edge of the mandrel panel being disposed in vertical alignment with the second target region of the second folding structure.

Optionally, the first folding structure comprises a third fold line extending from a first end of the first weakened line of severance disposed at a first side edge of the top panel to a point of intersection with the first fold line proximate the first aperture, and the first folding structure comprises a fourth fold line extending from a second end of the first weakened line of severance disposed at a first end edge of the top panel to the point of intersection of the third fold line with the first fold line, wherein the third fold line, fourth fold line and first weakened line of severance define third target region, and wherein the end of the first free edge of the mandrel panel is disposed in vertical alignment with the third target region of the first folding structure.

Optionally, the second folding structure comprises a fifth fold line extending from a first end of the second weakened line of severance disposed at a second side edge of the top panel to a point of intersection with the second fold line proximate the second aperture, and the second folding structure comprises a sixth fold line extending from a second end of the second weakened line of severance disposed at a first end edge of the top panel to the point of intersection of the fifth fold line with the second fold line, wherein the fifth fold line, sixth fold line and second weakened line of severance define fourth target region, and wherein the end of the second free edge of the mandrel panel is disposed in vertical alignment with the fourth target region of the second folding structure.

According to a fifth aspect of the present invention there is provided a carton for packaging one or more articles, the carton comprising a plurality of panels including a first top panel, a second top panel a base panel, a first side panel and a second side panel forming a tubular structure, the first top panel and the second top panel forming a composite top panel the first to panel and second to panel being disposed in at least partially overlapping relationship, the first to panel being disposed outermost, the composite top panel providing a handle structure, wherein the carton comprising a mandrel panel hinged to the second top panel and partially separated from the second to panel by a cutaway to define a free edge of the second top panel and a free edge of the mandrel panel the free edge of the second top panel being disposed in vertical alignment with the free edge of the mandrel panel to form a guide edge about which the first top panel is folded when the handle structure is employed.

Optionally, the handle structure comprises a first folding structure extending from a first end of a first handle aperture to a first corner of the top panel, the first folding structure comprising a first weakened line of severance extending between a first side edge of the top panel and a first end edge of the top panel, the first folding structure comprising a first fold line extending from a first end of the first handle aperture to the first weakened line of severance, wherein the first folding structure defines a first target region of the first top panel, the first target region being defined by a first notional line, a second notional line and the first weakened line of severance, the first notional line extending between a point at which the first fold line intersects the first end of the first handle aperture and a point at which the first weakened line of severance intersects the first side edge of the top panel, the second notional line extending between the point at which the first fold line intersects the first end of the first handle aperture and the point at which the first weakened line of severance intersects the first end edge of the first top panel, and wherein an end of the guide edge of the mandrel panel is disposed in vertical alignment with the first target region of the first folding structure.

Within the scope of this application it is envisaged and intended that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which.

DETAILED DESCRIPTION OF EMBODIMENTS

Detailed descriptions of specific embodiments of the package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
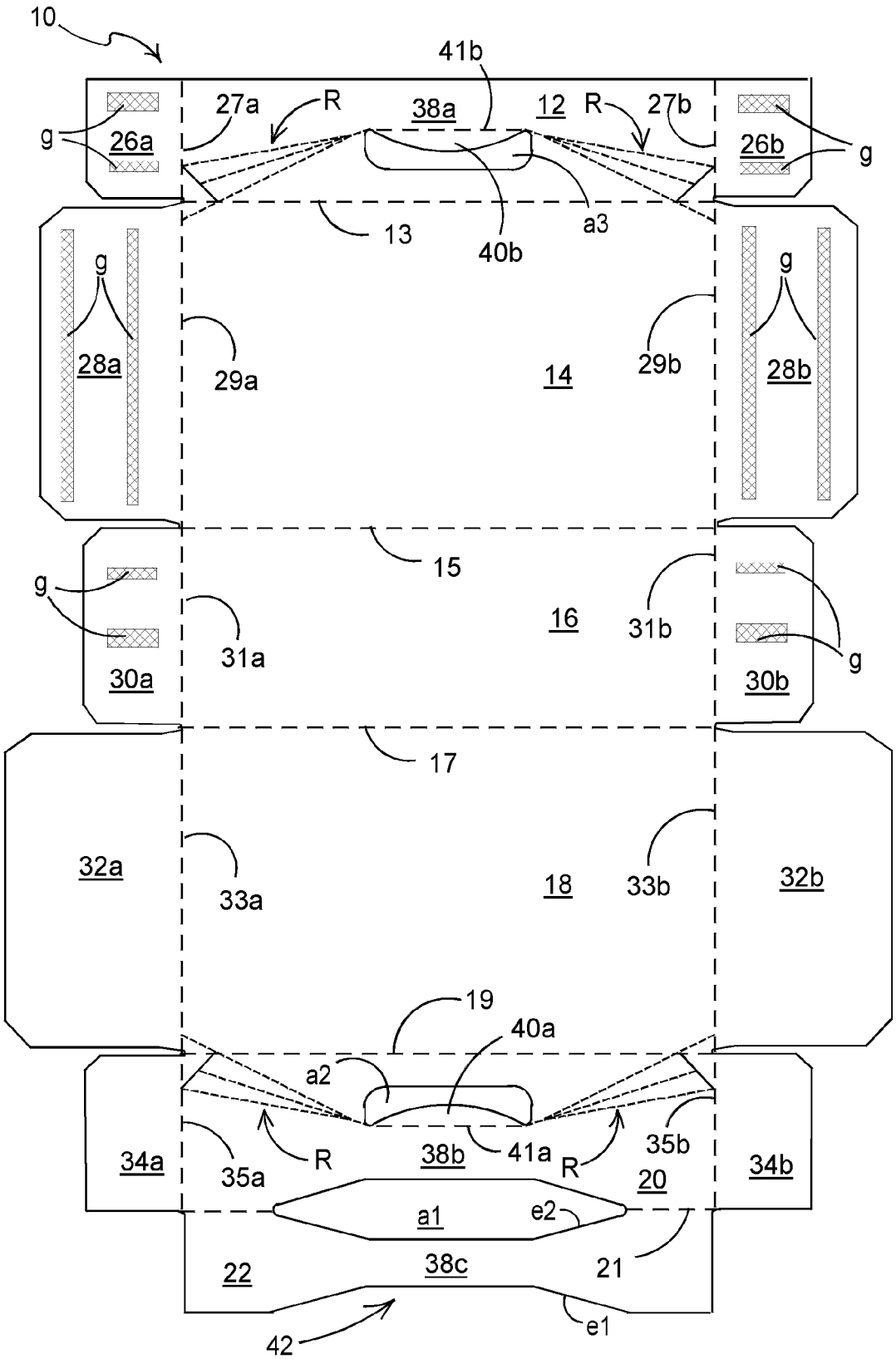
FIG. 1 is a plan view from above of a blank for forming a carton according to a first embodiment.
Figure 3:
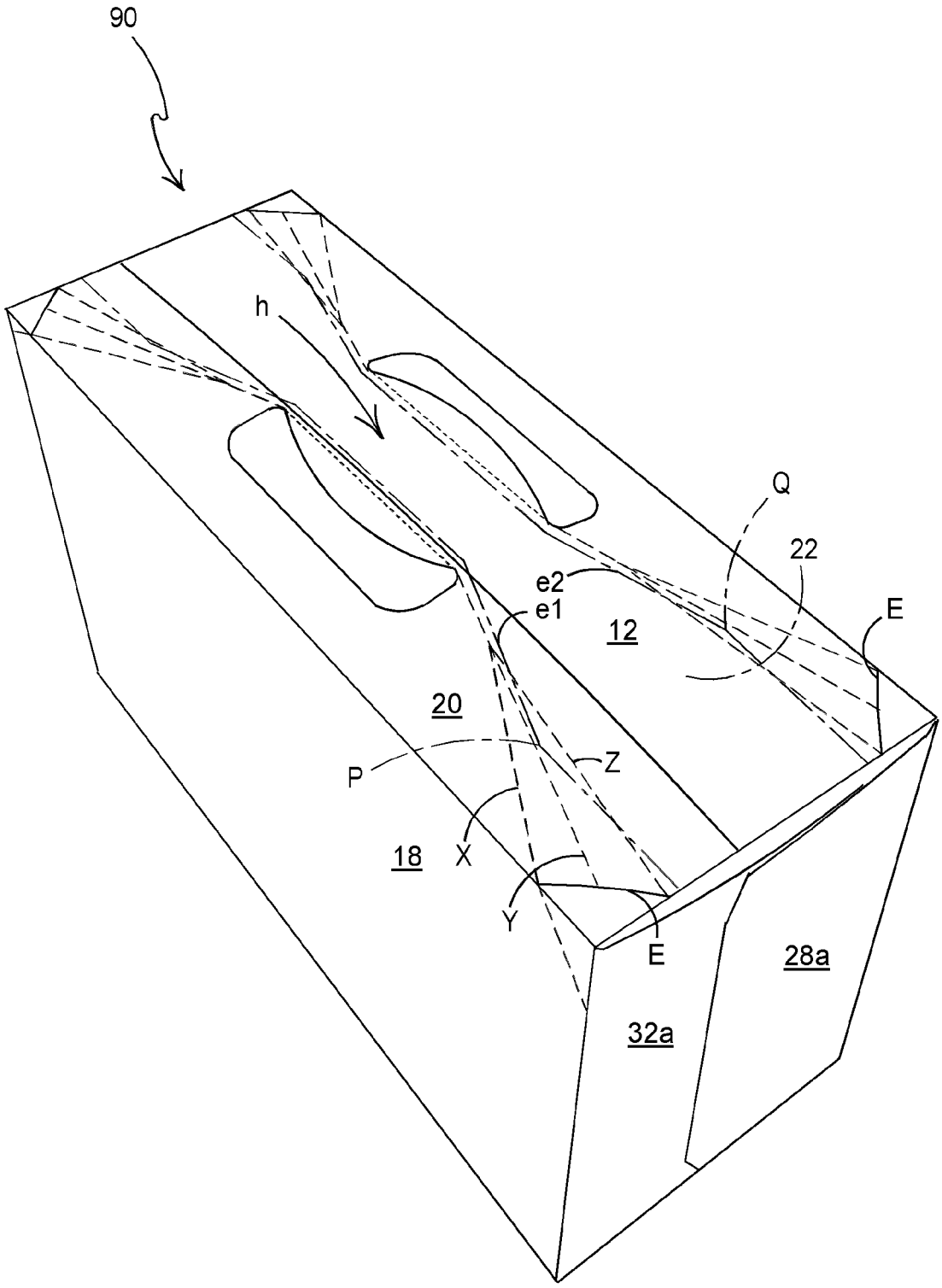
FIG. 3 is a perspective view from above of a carton formed from the blank of FIG. 1.

Referring to FIG. 1, there is shown a plan view of a blank 10 capable of forming a carton 90, as shown in FIG. 3, for primary products such as, but not limited to, cans or bottles, hereinafter referred to as articles B.

In the embodiments detailed herein, the terms "carton" and "carrier" refer, for the non-limiting purpose of illustrating the various features of the invention, to a container for engaging, carrying, and/or dispensing articles, such as product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

In the exemplary embodiment, the blanks are configured to form a carton or carrier for packaging an exemplary arrangement of exemplary articles. In a first illustrated exemplary embodiment, the arrangement is a 3×5 matrix or array and the articles are bottles. The blank can be alternatively configured to form a carrier for packaging other types, number and size of article and/or for packaging articles in a different arrangement or configuration.

The blank 10 comprises a plurality of main panels 12, 14, 16, 18, 20, 22 hinged one to the next in a linear series. The blank 10 comprises a first top panel 12 hinged to first side panel 14 by a hinged connection such as a fold line 13. The first side panel 14 is hinged to a base panel 16 by a hinged connection such as a fold line 15. The base panel 16 is hinged to a second side panel 18 by a hinged connection such as a fold line 17. The second side panel 18 is hinged to a second top panel 20 by a hinged connection such as a fold line 19. A mandrel panel 22 is hinged to the second top panel 20 by a hinged connection such as a fold line 21.

The plurality of main panels 12, 14, 16, 18, 20, 22 of the blank 10 form an open ended tubular structure in a set-up condition.

Each of the ends of the tubular structure is at least partially closed by end closure panels. In the illustrated embodiment the ends of the tubular structure are fully closed by end closure panels 26*a*, 28*a*, 30*a*, 32*a*, 34*a*, 26*b*, 28*b*, 30*b*, 32*b*, 34*b*.

End closure panels 26*a*, 28*a*, 30*a*, 32*a*, 34*a*, are configured to close a first end of the tubular structure and end panels 26*b*, 28*b*, 30*b*, 32*b*, 34*b*, are configured to close a second end of the tubular structure.

A first end closure panel 26*a* is hinged to a first end of first top panel 12 by a hinged connection such as a fold line 27*a*. A second end closure panel 28*a* is hinged to a first end of first side panel 14 by a hinged connection such as a fold line 29*a*. A third end closure panel 30*a* is hinged to a first end of base panel 16 by a hinged connection such as a fold line 31*a*. A fourth end closure panel 32*a* is hinged to a first end of the second side panel 18 by a hinged connection such as a fold line 33*a*. A fifth end closure panel 34*a* is hinged to a first end of second top panel 20 by a hinged connection such as a fold line 35*a*.

A sixth end closure panel 26*b* is hinged to a second end of first top panel 12 by a hinged connection such as a fold line 27*b*. A seventh end closure panel 28*b* is hinged to a second end of the first side panel 14 by a hinged connection such as a fold line 29*b*. An eighth end closure panel 30*b* is hinged to a second end of base panel 16 by a hinged connection such as a fold line 31*b*. A ninth end closure panel 32*b* is hinged to a second end of second side panel 18 by a hinged connection such as a fold line 33*b*. A tenth end closure panel 34*b* is hinged to a second end of second top panel 20 by a hinged connection such as a fold line 35*b*.

The first end closure panel 26*a* along with the fifth end closure panel 34*a* forms a minor upper end closure panel. The third end closure panel 30*a* forms a minor lower end closure panel. The second end closure panel 28*a* and the fourth end closure panel 32*a* each form a major side end closure panel.

The sixth end closure panel 26*b* along with the tenth end closure panel 34*b* together form a minor upper end closure panel. The eighth end closure panel 30*b* forms a minor lower end closure panel. The seventh end closure panel 28*b* and the ninth end closure panel 32*b* each form a major side end closure panel.

The blank 10 comprises an aperture a1. The mandrel panel 22 is defined in part by the aperture a1. The aperture a1 is struck in part from the mandrel panel 22 and in part from the second top panel 20.

The blank 10 comprises a recess 42. The mandrel panel 22 is defined in part by the recess 42.

The mandrel panel 22 comprises two opposing free side edges e1, e2, that is to say at least part of each of the side edges is free from connection to the blank 10. A first free edge e1 is defined in part by the recess 42 and a second free edge e2 is defined by a portion of the aperture a1. The first free edge e1 forms a first guide edge. The aperture a1 is symmetrical about the fold line 21 such that when mandrel panel 22 is folded about fold line 21 the second free edge e2 of the mandrel panel is in registry with the free edge of the second top panel 20 and form a second guide edge. The first free edge e1 converges with the second free edge e2 towards the grip portion 38*c*.

A first handle aperture a2 is struck from the second top panel 20. The first handle aperture a2 extends longitudinally, with respect to the tubular axis of the carton 90.

The second top panel comprises first tab 40*a* forming a cushioning flap. The first tab 40*a* is hinged to the second top panel 20 by a hinged connection such as a fold line 41*a*. The first tab 40*a* defines a portion of the edge or perimeter of the first handle aperture a2.

A second handle aperture a3 is struck from the first top panel 12. The second handle aperture a3 extends longitudinally, with respect to the tubular axis of the carton 90.

The first top panel comprises second tab 40*b* forming a cushioning flap. The second tab 40*b* is hinged to the first top panel 12 by a hinged connection such as a fold line 41*b*. The second tab 40*b* defines a portion of the edge or perimeter of the first handle aperture a3.

The first handle aperture a2 and the second handle aperture a3 form part of a handle structure h in a set-up carton 90 as shown in FIG. 3.

The first top panel 12 comprises a first handle grip portion 38*a*; the first handle grip portion 38*a* is defined in part by the fold line 41*b*. The second top panel 20 comprises a second handle grip portion 38*b*; the second handle grip portion 38*b* is defined in part by the fold line 41*a*. The mandrel panel 22 comprises a third handle grip portion 38*c*. In the illustrated embodiments the first, second and third handle grip portion 38*a*, 38*b*, 38*c* are centrally disposed with the handle structure h, in other embodiments the first, second and third handle grip portion 38*a*, 38*b*, 38*c* may be offset from the centre.

The blank 10 comprises a plurality of folding structures R which form part of the handle structure h. Each folding structure R comprises three fold lines and a weakened line of severance or cutline. The folding structures R predefine preferred locations at which the top panel 12/20 folds when the carrying handle h is employed. Each of the folding structures R form a relief device which controls or directs the load forces applied to the carton 90 when the carrying handle is employed. A first pair of folding structures defines a first side edge of a carrying handle. The first pair of folding structures comprises a first folding structure extending towards or into a first corner F of the first top panel 12 and a second folding structure extending towards or into a second corner of the first top panel 12. The first corner F, see FIG. 2, of the first top panel 12 is defined by fold line 27*a* and fold line 13. The second corner of the first top panel 12 is defined by fold line 27*b* and fold line 13. A second pair of folding structures defines a second side edge of the carrying handle. The second pair of folding structures comprises a third folding structure extending towards or into a third corner of the second top panel 20 and a fourth folding structure extending towards or into a fourth corner of the second top panel 20. The third corner of the second top panel

20 is defined by fold line 34*a* and fold line 19. The fourth corner of the second top panel 20 is defined by fold line 34*b* and fold line 19.

Figure 2:
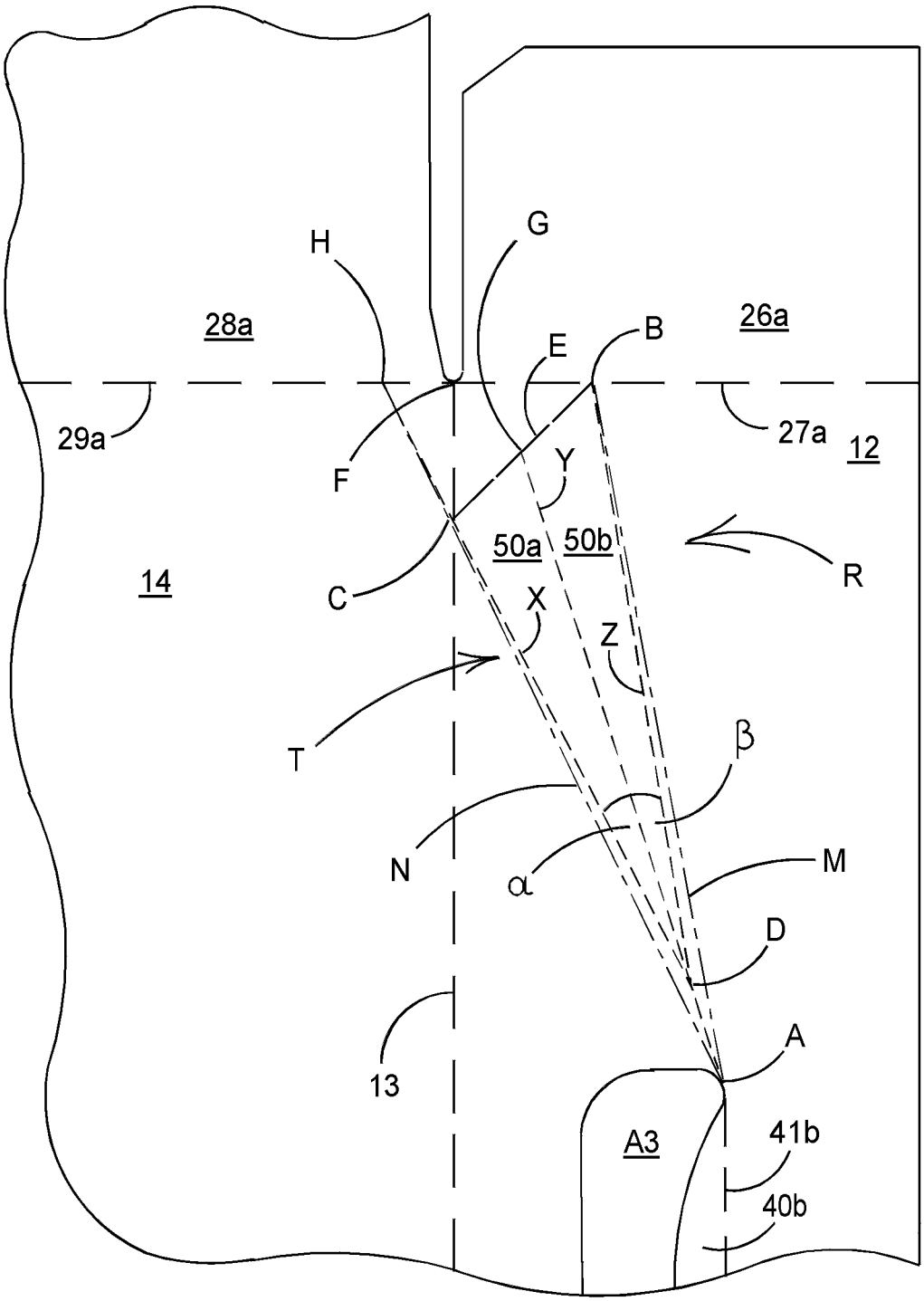
FIG. 2 is an enlarged plan view from above of a portion of the blank of FIG. 1.

Each of the folding structures R is substantially the same in construction and will be described in detail by reference to a first folding structure R disposed in the first top panel 12 as illustrated in FIG. 2.

The folding structure R comprises a first fold line Y. First fold line Y extends from an end edge of the second handle aperture a3, point A, adjacent to a terminal end of the fold line 41*b*, towards the end edge of the first top panel 12 defined by the fold line 27*a*.

A second fold line X extends from a point D disposed upon the first fold line Y towards the side edge of the first top panel 12 defined by the fold line 13. The second fold line X and the first fold line Y define an angle α therebetween, preferably the angle α is an acute angle more preferably less than about 30 degrees. In some embodiments the angle α is less than approximately 15 degrees for example around 10 degrees. The angle α may be in the range 8 to 10 degrees.

The second fold line X intersects the fold line 13 at a point C. The second fold line X continues into the first side panel 14. The second fold line X terminates at point H which is disposed upon the fold line 29*a* which hinges the second end closure panel 28*a* to the first side panel 14.

A third fold line Z extends from a point D disposed upon the first fold line Y towards the end edge of the first top panel 12 defined by the fold line 27*a*. The third fold line Z and the first fold line Y define an angle β therebetween, preferably the angle β is an acute angle, more preferably less than about 30 degrees. In some embodiments the angle β is less than approximately 15 degrees for example around 10 degrees. The angle β may be in the range 8 to 10 degrees.

The third fold line Z intersects the fold line 27*a* at a point B. The third fold line Z terminates at point B which is disposed upon the fold line 27*a* which hinges the first end closure panel 26*a* to the top panel 12.

A weakened line of severance E extends between the fold line 27*a* and the fold line 13. The weakened line of severance E extends between point B disposed upon the fold line 27*a*, the terminal end of fold line Z, and point C disposed upon the fold line 13, the point of intersection between the fold line 13 and the second fold line X. Preferably, the weakened line of severance E defines an angle of around 45 degrees with the fold line 13.

The first fold line Y intersects the weakened line of severance E at a point G. Point G is disposed between point C and point B. The first fold line Y terminates at the weakened line of severance E at the point G.

The weakened line of severance E, second fold line X and first fold line Y define a first triangular shaped portion 50*a* of the top panel 12.

The weakened line of severance E, third fold line Z and first fold line Y define a second triangular shaped portion 50*b* of the top panel 12.

Point H and point A define a first notional line N, shown in phantom (dashed) line in FIG. 2. Point B and point A define a second notional line M, shown in phantom (dashed) line in FIG. 2. The first notional line N and the second notional line M define a portion of the top panel 12. The portion of the top panel 12 is a target zone.

The point D is disposed proximate to the point A, preferably within 30 mm of point A. In some embodiments the point D is disposed in the range 10 mm to 20 mm of point A. More preferably the point D is disposed within the range 12 mm and 17 mm of point A.

Figure 4:
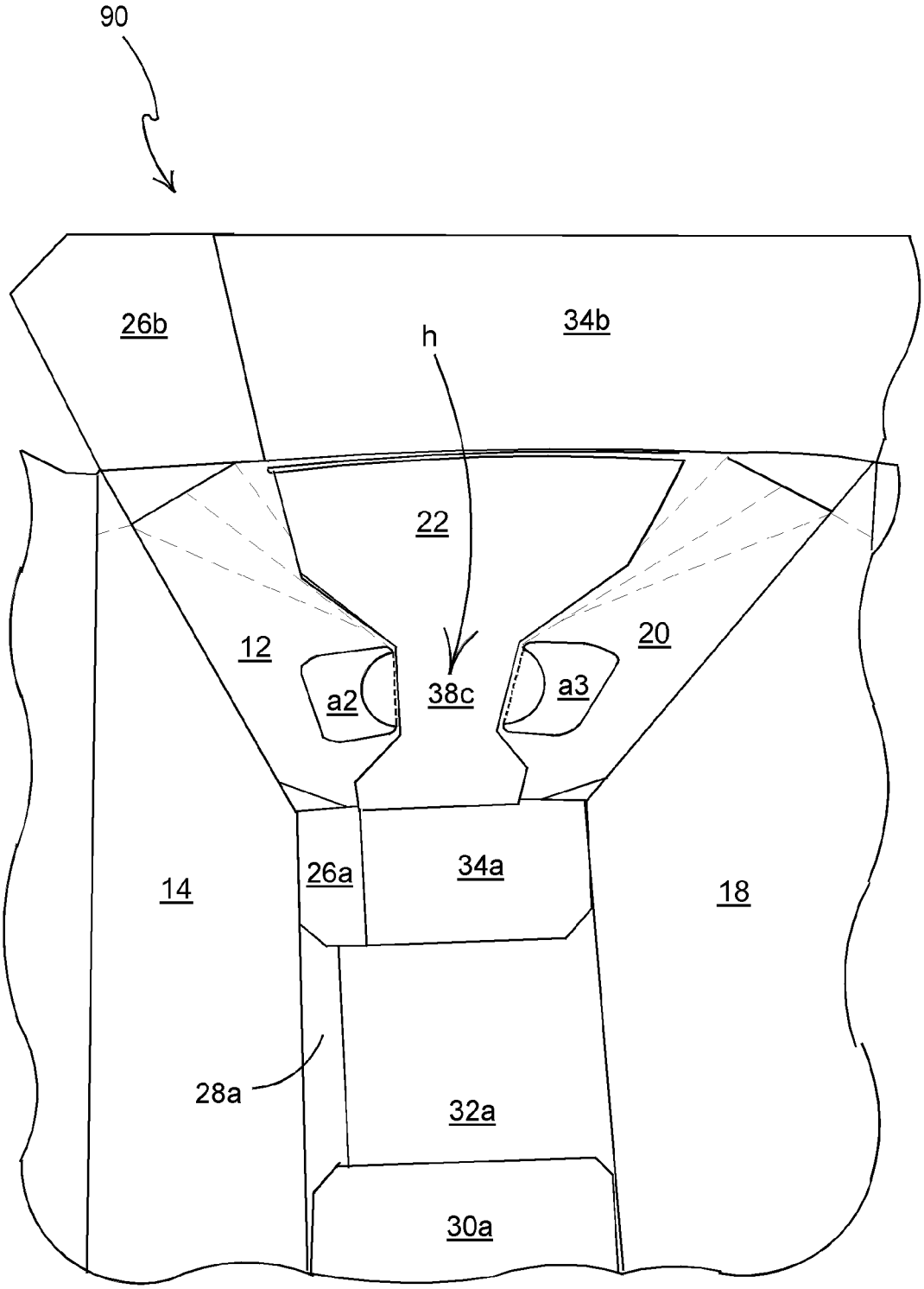
FIG. 4 is a perspective view from inside of a portion of the carton formed from the blank of FIG. 1 showing a mandrel panel below a top panel of the carton.

Turning to the construction of the carton 90 as illustrated in FIGS. 3 and 4, it is envisaged that the carton 90 can be formed by a series of sequential folding operations in a straight line machine so that the carton 90 is not required to be rotated or inverted to complete its construction. The folding process is not limited to that described below and may be altered according to particular manufacturing requirements.

Glue or other adhesive treatment is applied to the mandrel panel 22 or, in alternative embodiments, to a corresponding portion of the second top panel 20.

The blank 10 is folded about fold line 21 such that the mandrel panel 22 is brought into face contacting relationship with an inside surface of the second top panel 20. The mandrel panel 22 is secured to the second top panel 20.

The blank 10 is folded about fold line 17, such that the second top panel 20 and second side panel 18 are folded together thereabouts. The second side panel 18 is folded such that an inside surface is brought into face contacting relationship with an inside surface of the base panel 16 and the first side panel 14. The second top panel 20 is folded such that an inside surface is brought into face contacting relationship with an inside surface of the first side panel 14.

Glue or other adhesive treatment is applied to an inside surface of the first top panel 12 or, in alternative embodiments, to a corresponding portion of an outer surface of the second top panel 20.

The first top panel 12 is folded about the fold line 13 such that the first top panel 12 at least partially overlaps with the second to panel 20.

The first top panel 12 is secured to the second top panel 20, to form a composite top panel 12/20, in this way a flat collapsed carton is formed. The carton 90 may be shipped or distributed in this flat collapsed form.

In alternative embodiments the second top panel 20 may be secured to the first top panel 12 by alternative securing means for example, but not limited to, staples or other mechanical fixing means.

The flat collapsed carton may be erected into a tubular structure by separating the composite top panel 12/20 from the base panel 16.

The carton 90, in its open ended tubular form, may be loaded with articles through one or both open ends. It will be appreciated that in other embodiments one of the open ends of the carton 90 may be closed before loading the carton 90 with articles through the remaining open end.

In some embodiments, some or all of the end closure panels may be folded outwardly so as to create a funnel at the open end of the tubular structure for facilitating loading of the carton with articles.

Once the carton 90 is loaded with articles B the ends of the tubular structure are closed.

A first end of the tubular structure is closed by folding the first end closure panel 26*a* along with the fifth end closure panel 34*a*, the minor upper end closure panel, about fold lines 27*a*, 35*a* respectively. The third end closure panel 30*a*, the minor lower end closure panel is folded about fold line 31*a*.

Glue g or other adhesive treatment may be applied to the third end closure panel 30*a* or in alternative embodiments to a corresponding portion of the second end closure panel 28*a* or fourth end closure panel 32*a*.

Glue g or other adhesive treatment may be applied to the first end closure panel 26*a* and/or fifth end closure panel 34*a* or in alternative embodiments to a corresponding portion of the second end closure panel 28*a* or fourth end closure panel 32*a*.

The fourth end closure panel 32*a* is then folded about the fold line 33*a* to be brought into contact with the first end closure panel 26*a* and fifth end closure panel 34*a* and into contact with the third end closure panel 30*a* and optionally secured thereto.

Glue g or other adhesive treatment may be applied to the second end closure panel 28*a* or in alternative embodiments to a corresponding portion of the fourth end closure panel 30*a*.

The second end closure panel 28*a* is then folded about the fold line 29*a* to be brought into contact with the fourth end closure panel 32*a*.

The eighth end closure panel 30*b* forms a minor lower end closure panel. The seventh end closure panel 28*b* and the ninth end closure panel 32*b* each form a major side end closure panel.

A second end of the tubular structure is closed by folding the sixth end closure panel 26*b* along with the tenth end closure panel 34*b*, the minor upper end closure panel about fold lines 35*a*, 37*a* respectively.

The eighth end closure panel 28*b*, the minor lower end closure panel, is folded about fold line 31*b*.

Glue g or other adhesive treatment may be applied to the eighth end closure panel 30*b* or in alternative embodiments to a corresponding portion of the seventh end closure panel 28*b* or ninth end closure panel 32*b*.

Glue g or other adhesive treatment may be applied to the sixth end closure panel 26*b* and/or tenth end closure panel 34*b* or in alternative embodiments to a corresponding portion of the seventh end closure panel 28*b* or ninth end closure panel 32*b*.

The ninth end closure panel 32*b* is then folded about the fold line 33*b* to be brought into contact with the sixth end closure panel 26*b* and tenth end closure panel 34*b* and into contact with the eighth end closure panel 30*b* and optionally secured thereto.

Glue g or other adhesive treatment may be applied to the seventh end closure panel 28*b* or in alternative embodiments to a corresponding portion of the ninth end closure panel 30*b*.

The seventh end closure panel 28*b* is then folded about the fold line 29*b* to be brought into contact with the ninth end closure panel 32*b*.

FIG. 3 illustrates the assembled carton 90 forming a package with a plurality of articles. The location of the mandrel panel 22 is illustrated in phantom, dashed, lines. This illustrates how the mandrel panel 22 is positioned so as to provide an edge about which each of the top panels 12, 20 can fold when the carrying handle is in use. The edge e2 is aligned with the fold line Y provided in the first top panel 12.

It is desirable for the edge e1 and the edge e2 to be in vertical alignment with the respective fold line Y.

In some embodiments the edges e1 and e2 of the mandrel panel 22 are configured such that they are disposed below a target area T defined by the points A, B, C, as shown in FIG. 2.

Figure 5:
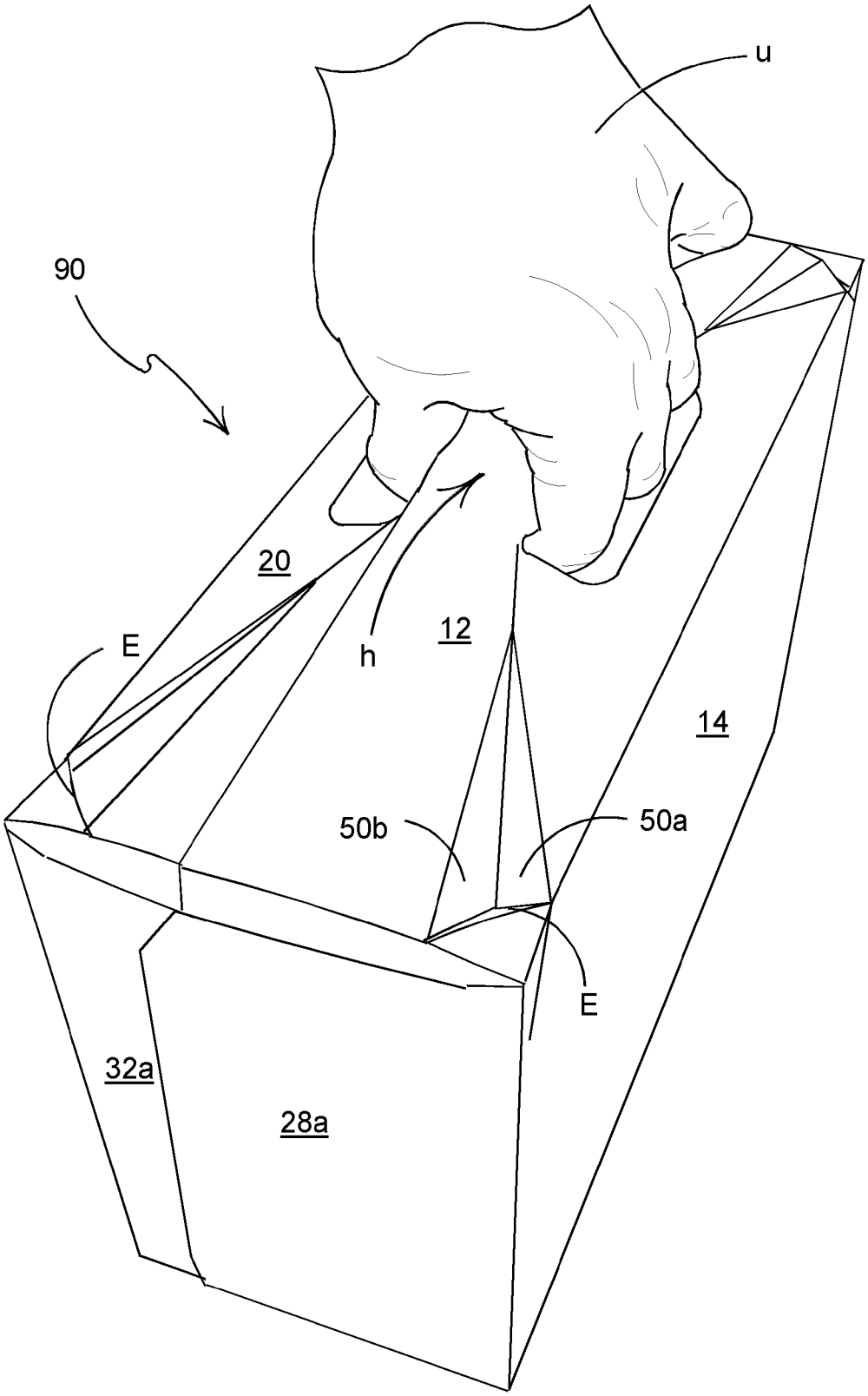
FIG. 5 is a perspective view from above of the carton of FIG. 1 showing a carrying handle in use.

The target area T is defined by a notional line N extending between point A and point C, and by a notional line M extending between point A and point B and by the weakened line of severance E. When the edges e1 and e2 of the mandrel panel 22 are disposed below the target area T the mandrel panel 22 facilitates folding of the first and second top panels 12, 20 when the carrying handle h is employed as shown in FIG. 5. FIG. 4 illustrates the internal volume of the carton 90 and shows the edges e1 and e2 of the mandrel panel 22 being disposed below the target area T.

In yet other embodiments as illustrated in FIG. 3 the terminal end P of the edges e1 and the terminal end Q of edge e2 is configured to as to be disposed in vertical alignment below the target area T. In some embodiments the terminal end P of the edges e1 and the terminal end Q of edge e2 may be disposed vertical alignment below a region 50*a*/50*b* defined by the first triangular shaped portion 50*a* and the second triangular shaped portion 50*b*; the region 50*a*/50*b* is defined by the second fold line X, the third fold line Z and the weakened line of severance E.

The edge e2 of the mandrel panel 22 is aligned with an edge of the second top panel 20 in this way the edge of the second top panel 20 also provides an edge about which the first top panel 12 may fold.

The grip portion 38*c* of the mandrel panel 22 is in vertical registry with the grip portion 38*b* of the second top panel 20 and the grip portion 38*a* of the first top panel 12. In this way the grip portion is a multiply structure, in this example a three ply structure.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" each refers to all manner of lines that define hinge features in a substrate of sheet material, for facilitating folding portions of the substrate with respect to one another, or otherwise for indicating optimal folding locations in the substrate. For example, a hinged connection should not be construed as necessarily referring to a single fold line only: indeed a hinged connection can be formed from one or more fold lines.

As used herein, the term "fold line" refers to one of the following: a scored line, an embossed line, a debossed line, a line of perforations, a line of short slits, a line of half-cuts, a single half-cut, an interrupted cut line, aligned slits, a line of scores and any combination of the aforesaid options.

As used herein, the term "weakened line of severance" refers to all manner of lines formed in a substrate of sheet material, that facilitate separating portions of the substrate from one another, or otherwise indicate optimal separation locations on the substrate. For example, a severance line in a substrate of sheet material is predisposed to allow a tear to propagate there along. A severance line may be one of the following: a single cut, a single half-cut, a single slit, an interrupted cut, a score line, an interrupted score line, a line of perforations, a line of short cuts, a line of short slits, a line of short half cuts, and any combination of the aforementioned options.

It should be understood that hinged connections, weakened lines of severance and fold lines can each include elements that are formed in the substrate of the blank including perforations, a line of perforations, a line of short slits, a line of half-cuts, a single half-cut, a cut line, an interrupted cut line, slits, scores, any combination thereof, and the like. The elements can be dimensioned and arranged to provide the desired functionality. For example, a line of perforations can be dimensioned or designed with degrees of weakness to define a fold line and/or a weakened line of severance. The line of perforations can be designed to facilitate folding and resist breaking to provide a fold line, to facilitate folding and facilitate breaking with more effort to provide a frangible fold line, or to facilitate breaking with little effort to provide a weakened line of severance.

The invention claimed is:

1. A carton for packaging one or more articles, the carton comprising a plurality of panels including a top panel, a base panel, a first side panel and a second side panel forming a tubular structure, one of the plurality of panels including a handle structure defined therein, the handle structure including a pair of first folding structures each having at least one first fold line defining a first edge of a handle strap and a pair of second folding structures each having at least one second fold line defining a second edge of the handle strap, the second edge opposing the first edge, the at least one first fold line of each of the first folding structures and the at least one second fold line of each of the second folding structures being defined, at least in part, in said one of the plurality of panels, wherein the carton further comprises a mandrel panel disposed in face contacting relationship with an inner surface of said one of the plurality of panels, the mandrel panel comprising a first free edge and a second free edge, the second free edge of the mandrel panel opposing the first free edge of the mandrel panel, the first free edge of the mandrel panel being configured to facilitate folding of the first folding structures, the second free edge of the mandrel panel being configured to facilitate folding of the second folding structures, the carton further comprising an aperture struck in part from the mandrel panel wherein a portion of the aperture defines the second free edge of the mandrel panel.

2. The carton according to claim 1 wherein each of the free edges of the mandrel panel are shaped complementary to the handle strap to provide a guide about which the first and second edges of the handle strap fold when the carrying handle is employed.

3. The carton according to claim 1 wherein said one of the plurality of panels is formed from a first panel and a second panel disposed in at least partially overlapping relationship.

4. The carton according to claim 3 wherein the first folding structures are defined in the first panel and the second folding structures are defined in the second panel.

5. The carton according to claim 3 wherein the mandrel panel is hinged to the innermost one of the first and second panels.

6. The carton according to claim 1 wherein the handle structure comprises a first aperture and a second aperture, the second aperture being spaced apart from the first aperture and defining at least part of the handle strap therebetween.

7. The carton according to claim 3 wherein the handle structure comprises a first aperture and a second aperture, the second aperture being spaced apart from the first aperture and defining at least part of the handle strap therebetween, and wherein the first aperture is struck from the first panel and the second aperture is struck from the second panel.

8. The carton according to claim 1 wherein each of the first folding structures comprises at least two fold lines.

9. The carton according to claim 8 wherein the at least two fold lines intersect one another at a common vertex.

10. The carton according to claim 1, the carton further comprising a recess struck from the mandrel panel wherein the recess defines at least a portion of the first free edge of the mandrel panel.

11. A blank for forming a carton, the blank comprising a plurality of panels for forming a top panel, a base panel, a first side panel and a second side panel forming a plurality of walls of a tubular structure in a set-up carton, one of the plurality of walls including a handle structure defined in at least one of the plurality of panels, the handle structure including a pair of first folding structures each having at least one first fold line defining a first edge of a handle strap and a pair of second folding structures each having at least one second fold line defining a second edge of the handle strap, the second edge opposing the first edge, the at least one first fold line of each of the first folding structures and the at least one second fold line of each of the second folding structures being defined, at least in part, in said one of the plurality of panels, wherein the blank further comprises a mandrel panel, the mandrel panel comprising a first edge and a second edge, the second edge of the mandrel panel opposing the first edge of the mandrel panel, the first edge of the mandrel panel being configured to facilitate folding of the first folding structures, the second edge of the mandrel panel being configured to facilitate folding of the second folding structures, wherein the second edge of the mandrel panel is a free edge, the blank further comprising an aperture struck in part from the mandrel panel wherein a portion of the aperture defines said second free edge of the mandrel panel.

12. The blank according to claim 11 wherein said one of the plurality of walls is a composite panel formed from a first panel of said plurality of panels and a second panel of plurality of panels, the first and second panels being configured to be disposed in at least partially overlapping relationship in a set-up carton.

13. The blank according to claim 12 wherein the first folding structures are defined in the first panel and the second folding structures are defined in the second panel.

14. The blank according to claim 12 wherein the mandrel panel is hinged to the first panel by a fold line.

15. The blank according to claim 11, wherein the first edge of the mandrel panel is a free edge, the blank further comprising a recess struck from the mandrel panel wherein the recess defines at least a portion of the first free edge of the mandrel panel.

16. The blank according to claim 15 wherein the first free edge of the mandrel panel is configured to align with the first folding structures.

17. The blank according to claim 15 wherein the second free edge of the mandrel panel is configured to align with the second folding structures.

18. A carton for packaging one or more articles, the carton comprising a plurality of panels including a top panel, a first side panel and a second side panel, the top panel provides a handle structure, the handle structure including a handle grip a first folding structure extending from a position adjacent to a first end of the handle grip toward a first corner of the top panel, wherein the first folding structure defines a first target region of the top panel, the first target region being defined at least by a first notional line and a second notional line, the first notional line extending between a first point adjacent to the first end of the handle grip and a second point on a first side edge of the top panel, the second notional line extending between the first point and a third point on a first end edge of the top panel, and wherein the carton comprises a mandrel panel disposed in face contacting relationship with an inner surface of the top panel, the mandrel panel comprising a first free edge, the first free edge being configured to facilitate folding of the first folding structure, an end of the first free edge of the mandrel panel being disposed in vertical alignment with the first target region of the first folding structure, wherein the carton further comprises an aperture struck in part from the mandrel panel wherein a portion of the aperture defines a second free edge of the mandrel panel.

19. The carton according to claim 18 wherein the second free edge of the mandrel panel opposes the first free edge, the first and second free edges being convergent towards the handle grip, the second free edge configured to facilitate folding of a second folding structure provided by the top panel, wherein the second folding structure defines a second target region of the top panel, the second target region being defined at least by a third notional line and a fourth notional line, the third notional line extending between a fourth point adjacent to the first end of the handle grip and a fifth point on a second side edge of the top panel, the fourth notional line extending between the fourth point and a sixth point on the first end edge of the top panel, an end of the second free edge of the mandrel panel being disposed in vertical alignment with the second target region of the second folding structure.

20. The carton according to claim 18, the carton further comprising a recess struck from the mandrel panel wherein the recess defines at least a portion of the first free edge of the mandrel panel.

* * * * *